US005966768A

United States Patent [19]

Hahn

[11] Patent Number: 5,966,768

[45] Date of Patent: Oct. 19, 1999

[54] ADJUSTABLE TUBE-CLEANER DEVICE

[75] Inventor: Robert B. Hahn, Virginia Beach, Va.

[73] Assignee: The Atlantic Group, Inc., Norfolk, Va.

[21] Appl. No.: 09/047,527

[22] Filed: Mar. 25, 1998

[51] Int. Cl.[6] ..... B08B 9/04

[52] U.S. Cl. ..... 15/104.061; 15/104.16; 15/104.17; 15/104.19

[58] Field of Search ..... 15/104.03, 104.05, 15/104.061, 104.16, 104.17, 104.18, 104.19

[56] References Cited

U.S. PATENT DOCUMENTS

| | | | |
|---|---|---|---|
| 451,841 | 5/1891 | Platt et al. | 15/104.19 |
| 460,986 | 10/1891 | Odell et al. | 15/104.18 |
| 491,791 | 2/1893 | Wilson | 15/104.17 |
| 576,425 | 2/1897 | Bilton et al. | 15/104.16 |
| 595,971 | 12/1897 | Rothenbucher | 15/104.16 |
| 849,786 | 4/1907 | Hildenbrand | 15/104.19 |
| 1,122,246 | 12/1914 | Beam | 92/87 |
| 1,608,347 | 11/1926 | Thompson et al. | 15/104.17 |
| 1,612,842 | 1/1927 | Thompson et al. | 15/104.18 |
| 2,170,997 | 8/1939 | Griffin | 15/104.16 X |
| 2,402,796 | 6/1946 | Wood | 15/104.061 |
| 2,636,202 | 4/1953 | Hinzman | 15/104.061 |
| 3,108,302 | 10/1963 | Whiteis | 15/104.16 |
| 3,124,821 | 3/1964 | Mathews | 15/104.16 |
| 4,891,115 | 1/1990 | Shishkin et al. | 204/212 |
| 5,305,488 | 4/1994 | Lyle | 15/104.061 |

FOREIGN PATENT DOCUMENTS

| | | | |
|---|---|---|---|
| 1674992 | 9/1991 | U.S.S.R. | 15/104.061 |

*Primary Examiner*—Mark Spisich
*Attorney, Agent, or Firm*—Griffin, Butler, Whisenhunt & Szipl, LLP

[57] ABSTRACT

Adjustable tube-cleaning device (10) has a scraper sub-assembly (16) which includes a substantially annular sleeve (32) on a circumferential outer surface (30) of an elastic core (14) which, in turn, is mounted on a central shaft (12). The sleeve (32) contracts toward a pre-formed, non-loaded configuration in which it has a smaller internal diameter than a diameter of the outer surface of the elastic core. The scraper assembly further includes a plurality of scrapping vanes (32) held by the sleeve to the elastic core and extending radially outwardly from the elastic core. Each of the scraping vanes has a scraping edge (54) directed radially away from the elastic core. The elastic core is substantially cylindrical and surrounds the central shaft between anchor (18) and adjustable compression member (26). The scraping vanes in one row of vanes can be placed on an angle relative to a plane perpendicular to an axis of the central shaft.

19 Claims, 3 Drawing Sheets

ADJUSTABLE TUBE-CLEANER DEVICE

BACKGROUND OF THE INVENTION

This invention relates to devices for cleaning insides of tubes or pipes, such as those found in heat exchangers, condensers, and other applications where tubes are susceptible to scale build-up, bio-fouling, or other heat-transfer-inhibiting deterioration.

Heat exchangers for steam turbines have anywhere from 3,500 to 70,000 tubes therein, each being from 20 to 115 feet long. The efficacy of these tubes as heat exchangers, depends to a large extent, on the speed with which heat is transferred through their walls. "Build-up" on interior surfaces of the walls of these tubes detracts from their ability to transfer heat. Thus, tube cleaning devices are used to clean interior surfaces of such tubes, as well as of other tubes and pipes.

U.S. Pat. No. 576,425 to Bilton et al discloses an appliance for scraping interiors of water mains or pipes including a screw-threaded spindle with two cones mounted thereon. Lever-like cutter blades mounted on each of the cones are expanded and contracted by stout rubber washers and regulating nuts mounted on the spindle behind the cutter blades. Thus, a scraping power of the cutter blades is obtained by adjusting each of the regulating nuts, which respectively bear on the rubber washers, for, in turn, bearing on the cutter blades.

U.S. Pat. No. 5,305,488 to Lyle similarly discloses a tube-cleaning tool having a central shaft and two truncated-cone-shaped cutters with cutter blades, mounted thereon. In this regard, each of the cutters has a hole through a central axis thereof through which the shaft passes so that the cutters can slide along the shaft. Also mounted on the central shaft, one adjacent each respective cutter, are flexible bushings to press against the cutters and exert outward pivoting pressure on the lever-like cutter blades, as in Bilton et al. In Lyle, the cutters can slide along the shaft and press against each other, so that adjustment of cutter blades of both cutters with one adjustment is allowed. The shaft used to secure the cutters and flexible bushings to one another is formed with a twist in order to offset the two cutters with respect to one another. The Lyle device is propelled through an interior of a tube by fluid projected against a separate tail portion on the device. The tail portion is formed with openings that allow some fluid to flush through the tail portion to the cutter blades of the device. The Lyle device can be formed with a flexible shaft to enable it to move through "U" bent tubing.

Other similar lever-blade expandable tube, or pipe, cleaning devices are disclosed in U.S. Pat. Nos. 1,122,246 to Beam; 1,608,347 to Thompson et al; 1,612,842 to Thompson et al; 2,402,796 to Wood; 2,636,202 to Hinzman; and 4,891,115 to Shishkin et al.

There are several difficulties with these tube cleaning devices. For one thing, it is very difficult and expensive to refurbish scraper blades thereof when they become worn because they attach to and lever from hubs. Also, it is difficult to control, and to make uniform, forces exerted by their scrapers on interior walls of tubes because the pressures their scrapers exert depend upon flexibilities of cutter blades as well as on force applying mechanisms at the hubs, including in some cases the elasticities of rubber washers, or bushings. In this regard, in both Bilton et al and Lyle, as resilient members are compressed, lever cutting blades pivot outwardly from central axis areas, or hubs (cones), thereby causing exaggerated motion of outer scraping areas of the lever cutting blades. This aggregated motion, along with the flexibility of the lever cutter blades, makes it difficult to achieve a predictable final adjusted movement and a predictable scraping pressure.

It is an object of this invention to provide an adjustable tube-cleaner device that can be manufactured and assembled simply and economically, that can be economically refurbished, and that can be reliably and accurately adjusted to produce a predictable scraping pressure with a fine movement adjustment.

SUMMARY OF THE INVENTION

According to principles of this invention, an adjustable tube-cleaner device has a scraper assembly which includes a substantially annular sleeve mounted on a circumferential outer surface of an elastic core which, in turn, is mounted on a central shaft. The sleeve contracts toward a pre-formed configuration in which it has a smaller internal diameter than a diameter of the outer surface of the elastic core. The scraper assembly further includes a plurality of scraping vanes held by the sleeve to the circumferential outer surface of the elastic core for extending radially outwardly from the sleeve. Each of the scraping vanes has a scraping edge directed radially away from the elastic core. The elastic core is substantially cylindrical and surrounds the central shaft between anchor and adjustable compression members.

The radial positions of the scraping edges can be adjusted relative to the central shaft by moving adjustable compression members along the shaft toward and away from one another to thereby compress and decompress the elastic core. This, in turn, radially expands and contracts the core outer surface and the resilient sleeve and scraping vanes mounted thereon for controlling a tightness with which the scraping edges of the scraping vanes fit in a tube being cleaned.

In one embodiment, scraping vanes in one row of scraping vanes are angled relative to a plane perpendicular to an axis of the elongated shaft for automatically rotating the tube cleaning device.

BRIEF DESCRIPTION OF THE INVENTION

The present invention is described and explained in more detail below using the embodiments shown in the drawings. The described and illustrated features, in other embodiments of the invention, can be used individually or in combination. The foregoing and other objects, features, and advantages of the invention will be apparent from the following more particular description of a preferred embodiment of the invention, as illustrated in the accompanying drawings in which reference characters refer to the same parts throughout the different views. The drawings are not necessarily to scale, emphasis instead being placed upon illustrating principles of the invention in a clear manner.

DESCRIPTION OF THE PREFERRED EMBODIMENT

Figure 1:
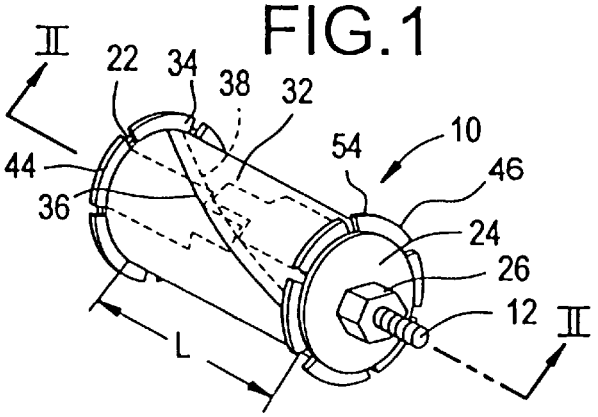
FIG. 1 is an isometric view of an adjustable tube cleaning device in a first embodiment of this invention.

An adjustable tube-cleaning device 10 comprises generally a central shaft 12, a substantially-cylindrical elastic core 14, and a scraper subassembly 16.

The central shaft 12 has an anchor, in the form of a head, 18 at one end thereof and threads 20 at an opposite threaded end thereof. An anchor washer 22 is mounted on the central shaft 12 abutting against the head 18 while an adjustable washer 24 is mounted on the central shaft 12 at the threads 20 abutting against a nut 26. The nut 26 is engaged with the threads 20 to form an adjustable compression device.

Figure 2:
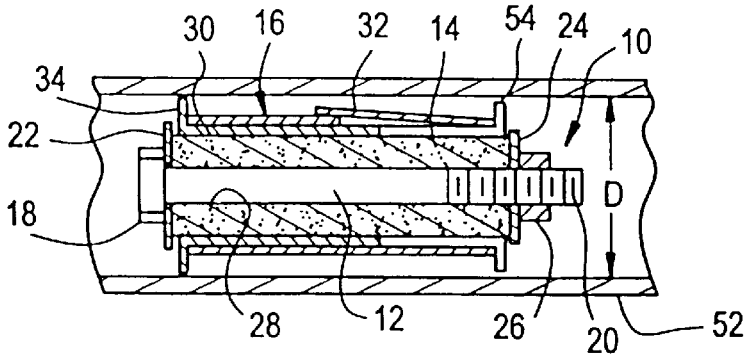
FIG. 2 is a cross-sectional view taken on line II—II in FIG. 1, but also including a pipe segment, the pipe segment being shown in section.

In one embodiment, the elastic core 14 is cylindrically shaped with a 0.549 inch outer surface diameter, with the central shaft 12 passing through a central bore 28 thereof, with the elastic core 14 being positioned between the anchor washer 22 and the adjustable washer 24. As can be seen in FIG. 2, outer perimeters of the anchor washer 22 and the adjustable washer 24 have greater circumferences than a cylindrically-shaped core outer surface 30 of the elastic core 14. In a preferred embodiment, the elastic core 14 is constructed of an expandable rubber, however, other elastic materials can also be used such as a closed cell polyurethane foam.

In the embodiment of the tube-cleaning device 10 depicted in FIGS. 1–4, the scraper subassembly 16 includes an annularly-shaped resilient, or flexible, sleeve 32 and, separate, scraping vane elements 34.

Figure 3:
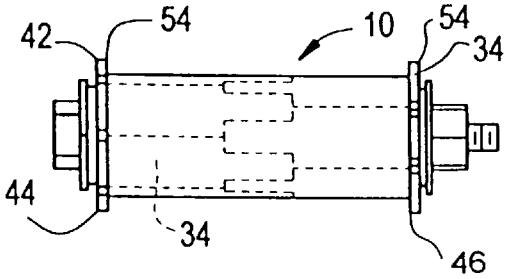
FIG. 3 is a plan view of the adjustable tube cleaning device of FIG. 1.

In the depicted embodiment of FIGS. 1–3, the annularly-shaped resilient sleeve 32 is constructed of spring steel having a thickness of 0.04 inches. The annularly-shaped resilient sleeve 32 thus forms a cylinder, as can be seen in FIGS. 1–3 which, if it were allowed to relax to an unloaded unstressed configuration, could have an inner diameter of around 0.767 inches for a tube-cleaning device used for scraping tubes having 1 inch outer diameters, as will be further described below. The length L of the sleeve 32 in one embodiment is around 1.188 inches. In the FIG. 1 embodiment the resilient sleeve 32 is cut longitudinally, but at a diagonal with the length, so that it has first and second diagonal ends 36 and 38 and it is pre-stressed so that when it is allowed to go to the unloaded, unstressed, configuration the first and second diagonal ends 36 and 38 overlap as is depicted in FIG. 1.

Figure 4:
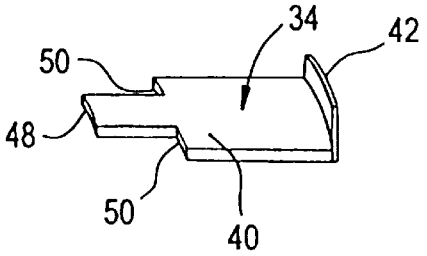
FIG. 4 is an isometric view of a single L-shaped scraping vane used in the embodiment of the adjustable tube cleaning device of FIG. 1.

Describing now the scraping vane elements 34, each of these is separate from the other vane elements and each is generally L-shaped, as can clearly be seen in FIG. 4, with a base leg 40 and a scraping leg 42 perpendicular to the base leg 40. The base leg 40 is somewhat rounded in its width so as to properly fit on the core surface 30. In this respect, first and second opposite rows 44 and 46 of vane elements 34 are placed on the core surface 30 with toes 48 of the base legs 40 of the first row 44 pointing toward those of the second row 46, and with the scraping legs 42 of all of the vane elements 34 extending perpendicularly away from the core surface 30, as can be clearly seen in FIGS. 1–3. The scraping vane elements are constructed of 0.022 inch thick spring steel in the preferred embodiment.

The toe 48 of each of the scraping vane elements 34 is narrower than the scraping leg 42, with the toe 48 and the scraping leg 42 being positioned at opposite ends of the base leg 40. In this regard, shoulders 50 are cut in each side of the base leg 40 between the toe 48 and the scraping leg 42 to narrow that portion of the base leg 40, thereby forming the toe 48. As can be seen in FIGS. 1 and 3, the shoulders 50 of adjacent scraping vane elements 34 in the first row 44 form slots into which the toes 48 of scraping vane elements from the second row 46 are inserted, and vice versa. In this manner, the scraping vane elements 34 of the first and second rows 44 and 46 inter-engage so that the respective scraping legs 42 in the first and second rows 44 and 46 are offset from one another. In one embodiment, the rows of scraping vanes, themselves, are separated from one another by 1.250 inches.

When the embodiment of the tube-cleaning device 10 of FIGS. 1–4 are fully assembled, the base legs 40 of the first and second rows 44 and 46 of scraping vane elements 34 are surrounded by the resilient sleeve 32, as can be seen in FIGS. 1–3, for holding the scraping vane elements 34 of the first and second rows 44 and 46 tightly against the outer core surface 30 of the elastic core 14. In this regard, the scraper subassembly 16, which is formed of the resilient sleeve 32 and the scraping vane element 34 of the first and second rows 44 and 46 are supported by the core surface 30 and the resilient sleeve 32 in this embodiment. In the depicted embodiment there are six (6) scraping vane elements 34 in each row 44, 46, but in other embodiments there are other numbers of scraping vane elements (such as eight (8)).

In operation, the elements of the tube-cleaning device 10 are assembled to appear as is depicted in FIGS. 1–3. For describing the manner of assembling, it will be assumed that the tube-cleaning device 10 will be used for cleaning tubes having a one inch outer diameter with 18, 20, or 22 gauge wall thickness. For this embodiment, the following dimensions could be used with the core 10 being in a relaxed condition (see FIG. 15):

| | |
|---|---|
| elastic core 14 relaxed diameter CD | 0.623 inch |
| scraping leg 42 height, 0.145 inch each × 2 = | + 0.290 inch |
| vane scraping diameter VD | 0.913 inch |
| inner diameter SD of relaxed sleeve 32 | 0.767 inch |
| elastic core 14 relaxed diameter CD | − 0.623 inch |
| space between relaxed core 14 and relaxed sleeve 32 | 0.144 inch |

A 1 inch OD pipe has the following internal diameters, depending on its gauge:

| | | |
|---|---|---|
| 18 gauge | ID | 0.902 inch |
| 20 gauge | ID | 0.930 inch |
| 22 gauge | ID | 0.944 inch |

Thus, when the core is in the relaxed position, there is a 0.144 inch space between the outer surface of the core and the inner surface of the relaxed sleeve 32. However, the thickness of the scraping vane elements 34 which are placed in this space are 0.022 inch×2=0.044, which does not fill this 0.144 inch space between the outer surface of the core 14 and the inner surface of the sleeve 32. For this reason, it is quite easy to insert the base legs 40 of the scraping vane elements 34 between the resilient sleeve 32 and the elastic core 14. Once all of the scraping vane elements 34 are in place, as is shown in FIGS. 1 and 2, the nut 26 is tightened so that the adjustable washer 24 is driven toward the anchor washer 22, thereby squeezing the elastic core 14 and forcing its outer surface, as well as the scraping vane elements 34, outwardly. Eventually, elements of the tube cleaning device 10 will have the following dimensions:

| | |
|---|---|
| inner diameter SD of sleeve 32 | 0.767 inch |
| elastic core 14 diameter CD | − 0.723 inch |
| space between core 14 and sleeve 32 | 0.044 inch |

Thus, the base legs 40 of the scraping vane elements 34, which are 0.022 inches thick×2=0.044 inches fits exactly between the sleeve and the core and is held therebetween by friction. In this configuration the following dimensions exist:

| | |
|---|---|
| elastic core 14 diameter CD | 0.723 inch |
| scraping leg 42 height 0.145 inch each × 2 = | + 0.290 inch |
| vane scraping diameter VD | 1.013 inch |

This is the size of the tube-cleaning device 10 when it is to be inserted into a 22 gauge 1 inch tube, which has an inner diameter of 0.944 inches.

When it is intended to use this tube-cleaning device for cleaning a tube, such as a condenser tube 52 of a condensing system in a steam power plant (not shown) a tube-cleaning device 10 is chosen which, when its elastic core is not substantially compressed between the anchor and adjustable washers 22 and 24, scraping edges 54 of its first and second rows 44 and 46 of scraping vane elements 34 define circles having diameters which are in a range of slightly smaller than to slightly larger than an interior diameter of the tube 52. The adjusting nut 26 is then tightened on the threads 20 of the central shaft 12 to drive the adjustable washer 24 toward the anchor washer 22, thereby compressing the elastic core 14 between the anchor and adjustable washers 22 and 24. This, in turn, causes the outer core surface 30 to move radially outwardly, thereby driving the scraping vane elements 34 outwardly and expanding the resilient sleeve 32 so that overlapping first and second end portions 36 and 38 of the resilient sleeve 32 slide on one another to create less overlap. During this procedure, the scraping vane elements 34 are continuously held tightly against the core surface 30 by the resilient sleeve 32. This adjustment is made until the scraping edges 54 fit snugly within the inner diameter D of the tube 52. At this point, the tube-cleaning device 10 is inserted into one end of the tube 52 and fluid pressure is applied to the tube 52 behind the tube-cleaning device to drive the tube-cleaning device through the tube 52. As the tube-cleaning device 10 is driven through the tube 52, its scraping edges 54 scrape along the interior surface of the tube 52 and thereby scrape off scale, fouling, or other build-up in the tube 52. The diameter of the outer core surface can be increased by at least 5% by tightening the nut 26.

In an enhanced embodiment of the structure depicted in FIGS. 1–3, the resilient sleeve 32 has a relaxed inner diameter of 0.60 inches. This inner diameter is smaller than the relaxed outer diameter CD of the elastic core 14 which, as is mentioned above, is 0.63 inch. When such a sleeve is in this relaxed condition, its ends 36 and 38 overlap. In order to place the elastic core 14 and the based legs 40 of the scraping vane element 34 between such a sleeve and the elastic core, one must expand the sleeve. A jig (not shown) can be employed for this purpose. Once the sleeve 32 and the scraping vane elements 34 are mounted on the elastic core 14, the first and second ends 36 and 38 of the resilient sleeve are held slightly spaced from one another to form a gap therebetween. In another embodiment, the height of the scraping leg 42 is 0.150 inch rather than 0.145 inch as is discussed in the example given above. All of the other dimensions can remain the same in this embodiment, however it should be understood that these dimensions can vary from one embodiment to the next and that the dimensions given above are exemplary of the particular embodiments of the invention described. Also, elements from the various embodiments can be combined in other ways.

Figure 5:
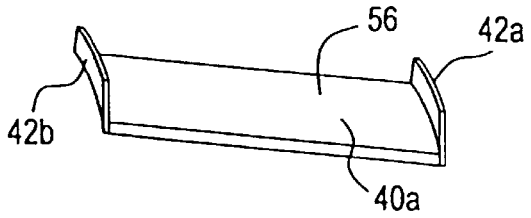
FIG. 5 is an isometric view of a U-shaped scraping vane used in a second embodiment adjustable tube cleaning device of this invention.
Figure 8:
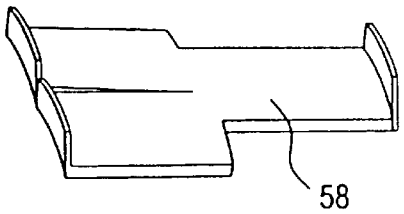
FIG. 8 is an isometric view of a scraping vane for use in a fourth embodiment adjustable tube cleaning device of this invention.

FIG. 5 depicts a second embodiment U-shaped scraping vane element 56 which forms scraping legs 42*a* and 42*b* for forming first and second rows similar to the first and second rows 44 and 46 of the FIG. 1 embodiment. Although the scraping legs 42*a* and 42*b* are shown in FIG. 5 directly opposite one another it would also be possible of offset them by properly shaping a base 40*a* of the U-shaped scraping vane element 56. Also, a scraping vane element 58 could be constructed as shown in FIG. 8, which is also U-shaped.

Figure 6:
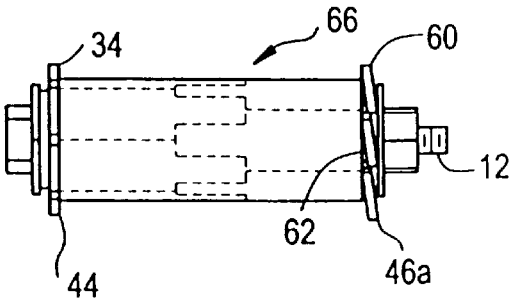
FIG. 6 is a plan view of a third embodiment adjustable tube cleaning device of this invention in which some scraping vanes are angled.
Figure 7:
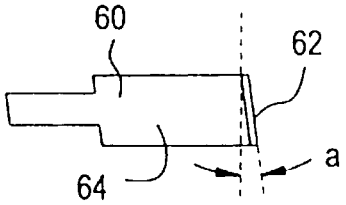
FIG. 7 is a plan view of an angled scraping vane of the third embodiment shown in FIG. 6.

FIG. 7 depicts another enhancement of the embodiment of FIGS. 1–4. The scraping vane element 60 (FIG. 7) of the FIG. 6 embodiment is like the scraping vane element 34 of the FIG. 1 embodiment, with the exception that its scraping leg 62 is on a 5°–20° angle (10° in a preferred embodiment) relative to a plane perpendicular to the length of its base leg 64. Thus, when the scraping element 60 is mounted on the elastic core 14, the scraping leg 60 is at an angle to a plane perpendicular to the axis of elongation of the central shaft 12.

In a tube-cleaning device 66 of the FIG. 6 embodiment, scraping vane elements 34 are used to form the first row 44 while the angled scraping vane elements 60 are used to form a second row 46*a*. The tube-cleaning device 66 is used in the same way as is the tube-cleaning device 10, however, when it is shoved through the tube 52 by fluid pressure the angled scraping legs 62 are driven by the fluid pressure to cause the tube-cleaning device 66 to rotate about the axis of its central shaft 12, thereby enhancing a cleaning effect of the tube-cleaning device 66.

Figure 9:
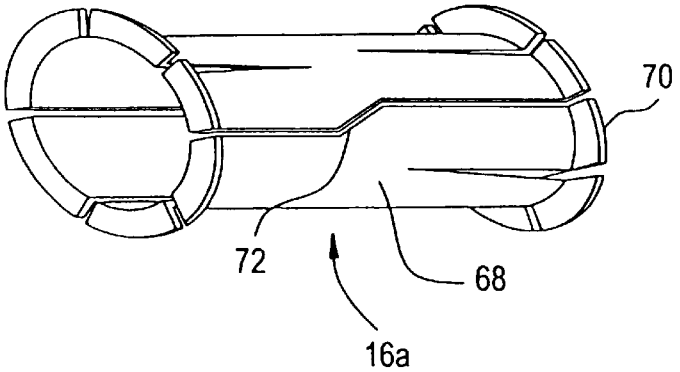
FIG. 9 is a perspective view of a combination annular sleeve and scraping vane unit of a fifth embodiment adjustable tube cleaning device of this invention.

FIG. 9 depicts an embodiment of this invention in which a resilient sleeve 68 and scraping vane elements 70 are formed as a scraper subassembly 16*a* which is made of one piece of spring steel. The scraper subassembly 16*a* can be constructed as one endless circular sleeve, or, it can have a break 72 therein with overlapping, or not overlapping ends. Again, the scraper subassembly 16*a* is held on the elastic core 14 primarily by compressing generated friction. It would also be possible to combine a scraper subassembly 16*a* with an outer resilient sleeve 32, by placing the outer resilient sleeve 32 about the scraper subassembly 16.

Figure 10:
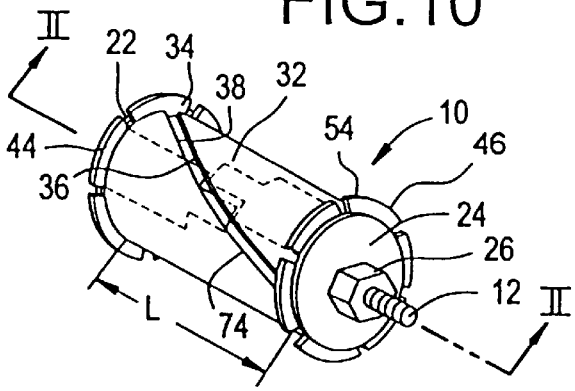
FIG. 10 is a view similar to FIG. 1 of a modified first embodiment of this invention.
Figure 11:
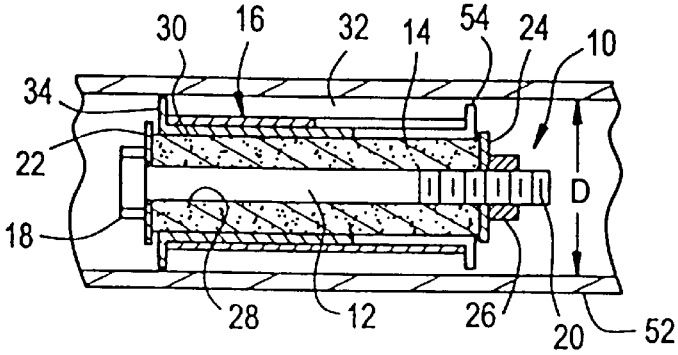
FIG. 11 is a view similar to FIG. 2, but of the modified first embodiment of this invention depicted in FIG. 10.
Figure 13:
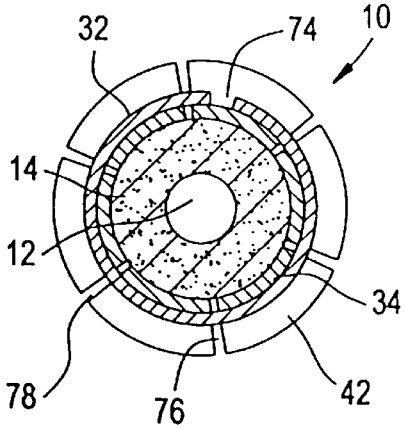
FIG. 13 is a cross-sectional view of an adjustable tube-cleaning device in an seventh embodiment of this invention.

FIGS. 10 and 11 depict a modified first embodiment of this invention which is identical to the embodiment of FIG. 1 with the exception that the first and second diagonal ends 36 and 38 of the resilient sleeve 32 do not overlap as they do in the FIG. 1 embodiment, rather there is a gap 74 of from 0.1–0.2 inches between the first and second diagonal ends 36 and 38. In another embodiment, which is identical with, or similar to, the embodiment depicted in FIGS. 10 and 11, the first and second ends 36 and 38 are not diagonal at all, but rather extend parallel to the axis of the central shaft 12. In fact, a cross-sectional view of a slightly-modified such tube-cleaning device 10 is depicted in FIG. 13. The embodiment depicted in FIG. 13 is identified as a seventh embodiment in that it not only has a gap 74 which is parallel with the axis of the central shaft 12 but in that it has the additional feature that the scraping legs 42 of the scraping vane elements 34 are fanned at their side edges 76 so that gaps 78 between the scraping legs 42 are quite small. This allows the scraping legs 42 to scrap greater areas along a tube being cleaned.

Figure 14:
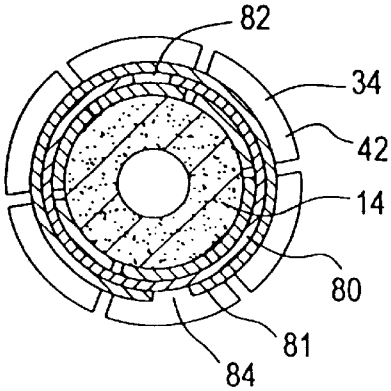
FIG. 14 is a cross-sectional view of an adjustable tube-cleaning device of this invention in an eighth embodiment of this invention.

An eighth embodiment depicted in FIG. 14 is the same as the embodiment depicted in FIG. 13 with the exception that instead of having only one resilient sleeve 32, there are two concentric resilient sleeves, namely, an inner resilient sleeve 80 and an outer resilient sleeve 81. Both the inner and outer resilient sleeves 80 and 81 have gaps 82 and 84. An advantage in having a gap, such as the gap 74 of the FIG. 13 embodiment, and the gaps 82 and 84 of the FIG. 14 embodiment, rather than an overlap, as is shown in FIG. 1, is that the sleeve applies a more even pressure on the scraping vane elements so that some scraping legs 42 of the scraping vane elements 34 do not protrude radially outwardly more than other. The two resilient sleeves of the eighth embodiment of FIG. 14 apply the pressure yet more uniformly. FIG. 14 also shows the flared, or fanned, scraping legs 42 of the scraping vane element 34.

Figure 15:
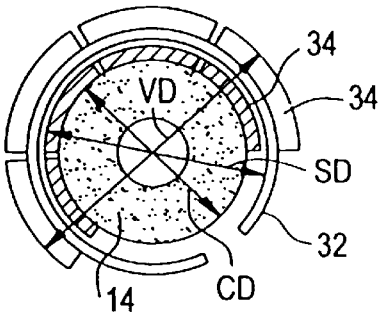
FIG. 15 is an end view of elements depicted in FIG. 13.

FIG. 15 is simplified to only show the elastic core 14 and the scraping vane elements 34, with their flared scraping legs 42. The dimensions referred to above are also designated on this drawing.

Figure 12:
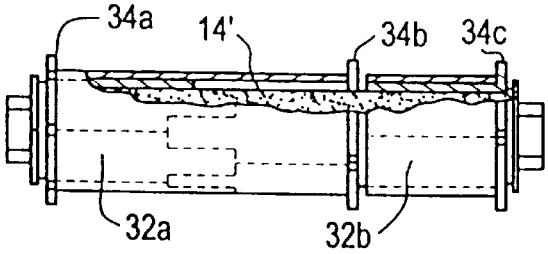
FIG. 12 is a cutaway side view of an adjustable tube-cleaning device in a sixth embodiment of this invention.

Finally, FIG. 12 depicts a sixth embodiment of this invention in which three rows of scraping vane elements 34*a*, 34*b*, and 34*c* are all mounted on an extra long elastic core 14'. In this case two axially-spaced resilient sleeves 32*a* and b are required, with the resilient sleeve 32*a* holding the scraping vane elements 34*a* and 34*b* to the elastic core 14' and the resilient sleeve 32*b* holding the scraping vane elements 34*c* to the elastic core 14'. In another embodiment, not depicted, rather than having a single elongated elastic core 14', there are two elastic cores, one being of a length of the elastic core 14 of the FIGS. 1 and 10 embodiments, and the other being a shorter elastic core on embodiment, not depicted, rather than having a single elongated elastic core 14', there are two elastic cores, one being of a length of the elastic core 14 of the FIGS. 1 and 10 embodiments, and the other being a shorter elastic core on which the scraping vane elements 34*c* are mounted. In this case a washer would be inserted between the elastic core on which the scraping vane elements 34*b* are mounted and the elastic core on which the scraping vane elements 34*c* are mounted.

An important benefit of the tube-cleaning device of this invention is that since the scraping vane elements thereof are only held primarily by friction to the elastic core, they can be relatively easily replaced for refurbishing the tube-cleaning device 10 by merely loosening the resilient sleeve. In this regard, the scraping edges 54 of the scraping legs 42 periodically wear so that the scraping vane elements must be replaced.

Another benefit of this invention related to its shape and size is that it does not require a special separate fluid contact element, or impeller, to drive it through tubes because the scraping legs and the washers themselves substantially fill the tubes, thereby forming an adequate fluid contact element which also allows passage of some fluid for cleaning. In fact in the FIG. 6 embodiment, where there are angled scraping legs, the scraping legs also serve to rotate the tube cleaning device as it is being driven along a tube for enhancing its cleaning ability.

Yet another benefit of this invention is that radially inside ends of the scraping legs bare directly against the elastic core rather than via metallic spring leaves as in most prior-art devices. Because of this, the pressure with which the scraping legs 42 exert against inside surfaces of tubes is dependent primarily only on the elasticity and resilience of the elastic core 14. Thus, the scraping pressure exerted by the scraping legs 42 is more predictable and easier to regulate than it is for most prior-art tube-cleaning devices.

Each scraping vane element is easily inserted into, and removed from, the tube-cleaning device of this invention by relieving the tension on the elastic core 14 by loosing the nut 26, placing it into the enlarged space between the core and the sleeve, and than again tightening the nut 26.

The invention has been particularly shown and described with reference to a preferred embodiment. It will be understood by those skilled in the art that various changes in form and detail may be made therein without departing from the spirit and scope of the invention.

The invention claimed is:

1. An adjustable tube-cleaning device for passing through a tube for cleaning the tube comprising:

a central shaft having an anchor engaged therewith at one end portion thereof and an adjustable compression means adjustably engaged therewith at an opposite end portion thereof for being selectively moveable along said central shaft;

a substantially-cylindrical elastic core surrounding the central shaft between the anchor and the adjustable compression means for being compressed and decompressed by said adjustable compression means; and a scraper assembly including a substantially annular resilient sleeve mounted only on a circumferential outer surface of the elastic core by resilience of the resilient sleeve contracting toward a pre-formed configuration in which the substantially annular sleeve presses against the outer surface of the elastic core without engaging said central shaft, said scraper assembly further including a plurality of scraping vanes extending radially outwardly from said annular sleeve, each of said scraping vanes having a scraping edge directed radially away from the elastic core;

wherein radial positions of the scraping edges relative to the central shaft can be adjusted by moving the adjustable compression means along the shaft to thereby compress and decompress the elastic core and, in turn, radially expand and contract the outer surface of the elastic core and the resilient sleeve mounted thereon for controlling a tightness with which the scraping edges fit in a tube being cleaned.

2. An adjustable tube-cleaning device as in claim 1 wherein a length of the device is less than twice the width of the device.

3. An adjustable tube-cleaning device as in claim 1 wherein the scraping vanes of the device are positioned side by side to form an annular row of scraping legs about the elastic core, which row forms a circular wall having a diameter which is greater than all other elements forming the tube-cleaning device.

4. An adjustable tube-cleaning device as in claim 1 wherein the sleeve and vanes are formed as one piece with each vane being an L-shaped member separated circumferentially from adjacent other vanes, there being first and second rows of scraping vanes spaced axially from one another along said substantially-cylindrical elastic core.

5. An adjustable tube-cleaning device as in claim 1 wherein the core is formed of rubber.

6. An adjustable tube-cleaning device as in claim 1 wherein the outer core surface of the elastic core can expand its radius by 5%.

7. An adjustable tube-cleaning device for passing through a tube for cleaning the tube comprising:

a central shaft having an anchor engaged therewith at one end portion thereof and an adjustable compression means adjustably engaged therewith at an opposite end portion thereof for being selectively moveable along said central shaft;

a substantially-cylindrical elastic core surrounding the central shaft between the anchor and the adjustable compression means for being compressed and decompressed by said adjustable compression means; and a scraper assembly including a substantially annular resilient sleeve mounted on a circumferential outer surface of the elastic core by resilience of the resilient sleeve contracting toward a pre-formed configuration in which the substantially annular sleeve presses against the outer surface of the elastic core, said scraper assembly further including a plurality of scraping vanes extending radially outwardly from said annular sleeve, each of said scraping vanes having a scraping edge directed radially away from the elastic core;

wherein radial positions of the scraping edges relative to the central shaft can be adjusted by moving the adjustable compression means along the shaft to thereby compress and decompress the elastic core and, in turn, radially expand and contract the outer surface of the elastic core and the resilient sleeve mounted thereon for controlling a tightness with which the scraping edges fit in a tube being cleaned;

wherein the scraper assembly comprises a sleeve which is separate from the scraping vanes, and which surrounds and compresses on the scraping vanes to hold the scraping vanes on the outer surface of the elastic core.

8. An adjustable tube-cleaning device as in claim 7 wherein the sleeve is formed of cylindrically-shaped spring steel.

9. An adjustable tube-cleaning device as in claim 7 wherein the sleeve has a longitudinal break therein.

10. An adjustable tube-cleaning device as in claim 7 wherein each scraping vane is formed of a separate piece of material.

11. An adjustable tube-cleaning device as in claim 10 wherein each of the scraping vanes has an L-shape with a base leg for being clamped between the sleeve and the outer surface of the elastic core, and a scraping leg for extending laterally to the base leg, and radially from the core.

12. An adjustable tube-cleaning device as in claim 11 wherein there are first and second rows of scraping vanes mounted on the elastic core.

13. An adjustable tube-cleaning device as in claim 11 wherein there are first and second opposite rows of scraping vanes, the scraping legs of the scraping vanes of the first and second rows being positioned at respective opposite ends of the sleeve.

14. An adjustable tube-cleaning device as in claim 13 wherein there are 6 scraping vanes in each of the first and second rows.

15. An adjustable tube-cleaning device as in claim 13 wherein the base legs of the scraping vanes of the first and second rows inter-engage with one another.

16. An adjustable tube-cleaning device as in claim 13 wherein the scraping legs of each of the scraping vanes in at least one of the first and second rows are angled relative to a plane perpendicular to an axis of the central shaft.

17. An adjustable tube-cleaning device as in claim 16 wherein the angle is about 10°.

18. An adjustable tube-cleaning device as in claim 10 wherein each of the vanes has a U-shape, with a base of the U being clamped between the sleeve and the elastic core, and legs of the U forming scraping legs extending radially away from the elastic core at opposite ends of the sleeve.

19. An adjustable tube-cleaning device as in claim 5 wherein scraping legs of scraping vanes are angled relative to a plane perpendicular to an axis of elongation of the shaft.

* * * * *